US009515425B2

(12) United States Patent
Underwood

(10) Patent No.: US 9,515,425 B2
(45) Date of Patent: Dec. 6, 2016

(54) ELECTRICAL SOCKET

(75) Inventor: Geoffrey Paul Underwood, Newport (GB)

(73) Assignee: IFPL GROUP LIMITED, Newport, Isle of Wight (GB)

( * ) Notice: Subject to any disclaimer, the term of this patent is extended or adjusted under 35 U.S.C. 154(b) by 0 days.

(21) Appl. No.: 14/343,673

(22) PCT Filed: Sep. 7, 2012

(86) PCT No.: PCT/GB2012/052213

§ 371 (c)(1),
(2), (4) Date: Mar. 31, 2015

(87) PCT Pub. No.: WO2013/034929

PCT Pub. Date: Mar. 14, 2013

(65) Prior Publication Data

US 2015/0200498 A1 Jul. 16, 2015

(30) Foreign Application Priority Data

Sep. 9, 2011 (GB) ..... 1115628.8

(51) Int. Cl.

| | |
|---|---|
| ***H01R 13/717*** | (2006.01) |
| ***H01R 13/66*** | (2006.01) |
| ***H01R 13/703*** | (2006.01) |
| ***H01R 24/58*** | (2011.01) |

(52) U.S. Cl.

CPC ..... *H01R 13/717* (2013.01); *H01R 13/66* (2013.01); *H01R 13/6683* (2013.01); *H01R 13/7031* (2013.01); *H01R 24/58* (2013.01)

(58) Field of Classification Search

None

See application file for complete search history.

(56) References Cited

U.S. PATENT DOCUMENTS

| | | | | |
|---|---|---|---|---|
| 6,370,252 | B1 | 4/2002 | Lunter | |
| 7,209,048 | B1 | 4/2007 | Pace et al. | |
| 7,579,832 | B1 * | 8/2009 | Blackburn | H04R 3/00 324/300 |
| 2007/0001866 | A1 | 1/2007 | Sebescak | |
| 2008/0298607 | A1 | 12/2008 | Wu et al. | |
| 2008/0305676 | A1 * | 12/2008 | Fiennes | H01R 13/7031 439/489 |
| 2009/0086985 | A1 | 4/2009 | Zhang et al. | |
| 2009/0190768 | A1 * | 7/2009 | Cui | H04R 29/008 381/58 |
| 2010/0215183 | A1 | 8/2010 | Hansson et al. | |
| 2011/0099298 | A1 | 4/2011 | Chadbourne et al. | |

FOREIGN PATENT DOCUMENTS

| | | | |
|---|---|---|---|
| WO | WO2009077004 | 6/2009 | |
| WO | WO 2009077004 A1 * | 6/2009 | H01R 13/665 |

* cited by examiner

*Primary Examiner* — Curtis Kuntz
*Assistant Examiner* — Kenny Truong
(74) *Attorney, Agent, or Firm* — Ober, Kaler, Grimes & Shriver; Royal W. Craig

(57) ABSTRACT

An audio interface (1) comprising a socket (3) arranged to receive a plug (30), the socket arranged to transfer an audio signal to the plug when connected to the socket, the interface comprising a detector (10) to determine whether an audio signal is received at the socket, the detector arranged to cause generation of a test signal to indicate that an audio signal is received at the socket, at least when the plug is not connected to the socket.

15 Claims, 3 Drawing Sheets

ELECTRICAL SOCKET

TECHNICAL FIELD

The present invention relates generally to electrical sockets.

BACKGROUND

It is known for passenger aircraft to include 'at-seat' passenger entertainment systems, with a passenger entertainment station being provided for each passenger, installed in or adjacent to each passenger's seat. Such systems allow passengers to insert a plug of a headphone set (or indeed other sound reproduction equipment) into an audio socket of the station and then listen to audio content provided by the system. Such systems typically allow each passenger to select one of a number of channels, for example including music or the spoken word, in conjunction with, or independently of, displayed visual content. During changeover periods between passengers leaving the aircraft and prior to new passengers boarding the aircraft, aircraft crew need to ensure that each passenger entertainment station is functioning correctly (prior to arrival of the new passengers). This check may include inserting the plug of a headphone set into the socket, or jack, of each station and verifying that there is audible content. We have realised that this procedure could be made more efficient by providing an improved passenger entertainment system.

SUMMARY

According to a first aspect of the invention there is provided an audio interface comprising a socket arranged to receive a plug, the socket arranged to transfer an audio signal to the plug when connected to the socket, the interface comprising a detector to determine whether an audio signal is received at the socket, the detector arranged to cause generation of a test signal to indicate that an audio signal is received at the socket, at least when the plug is not connected to the socket.

The detector may be arranged to cause the test signal to be generated only when the plug is not connected to the socket. Preferably, the detector causes discontinuation of generation of the test signal when, and during, it is determined that the plug is connected to the socket.

The detector may comprise a switch which controls generation of the test signal, based on whether the switch is open or closed. The detector may be arranged to deactivate a test signal generator when it is determined that the plug is connected to the socket.

The detector may be arranged to cause the test signal to be generated when it is determined that an audio signal is received at an electrical terminal of the socket. The detector may be arranged to cause generation of the test signal when it is determined that an audio signal is received at both or all of the electrical terminals of the socket.

The test signal may be arranged to be received locally or remotely of the interface. The test signal generated may comprise a visual indication. The visual indication may be provided by a light generating component. The light-generating component may be provided as part of the interface, and may be provided adjacent to the socket.

The test signal may be generated using (electrical) power sourced from the audio signal. The detector may be such as to direct the audio signal towards a test signal generator when the plug is not connected to the socket.

The interface may comprise a resilient element which is arranged to engage with a pin of the plug such that on connection of the plug to the interface the resilient element serves as a switch to direct audio signal away from generating a test signal to be directed to an output of the plug, and when the plug is not connected to the interface, the resilient element directs the audio signal towards a test signal generator. The resilient element is preferably an electrical terminal arranged to carry an audio signal and preferably selectively transfer the signal to the plug or to the test signal generator.

Alternatively, instead of the test signal being generated from power of the audio signal, the signal may be generated from a separate power supply, and wherein the detector causes a test signal generator to be selectively connected to the power supply dependent on whether the plug is connected to the socket.

The detector preferably serves to determine whether the plug is connected to or disconnected from the socket.

The detector may be an active or passive component.

The interface may be a passenger audio interface for an aircraft, or other passenger transportation. Moreover, the audio interface may be used in any application in which many audio interfaces are provided, which, in addition to passenger transportation (such as planes, trains, coaches, buses and mass transportation), includes venues such as stadia, theatres, conference centres, classrooms etc.

According to a second aspect of the invention there is provided a test system for a plurality of audio interfaces, the system comprising a plurality of audio interfaces of the first aspect, and an output device to information derived from received test signals from the audio interfaces.

BRIEF DESCRIPTION OF THE DRAWINGS

Various embodiments of the invention will now be described, by way of example only, with reference to the following drawings in which.

DETAILED DESCRIPTION

Figure 2:
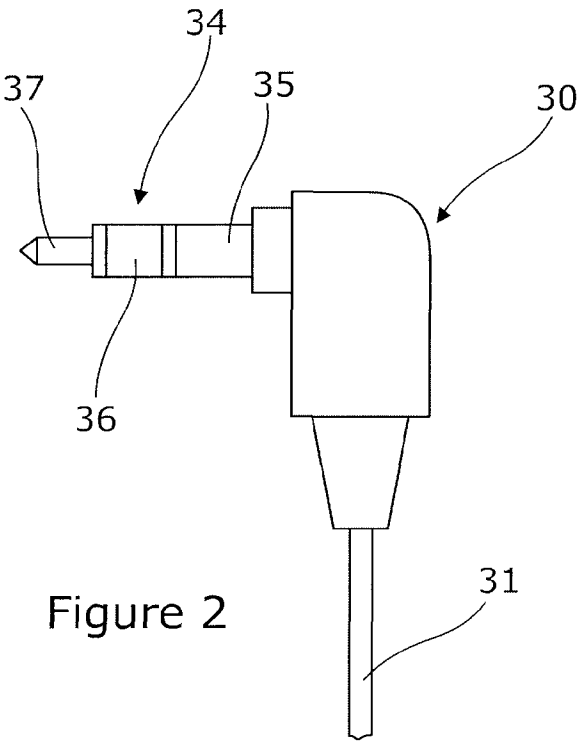
FIG. 2 is a side view of a plug which is insertable into the socket of the interface of FIG. 1.
Figure 1:
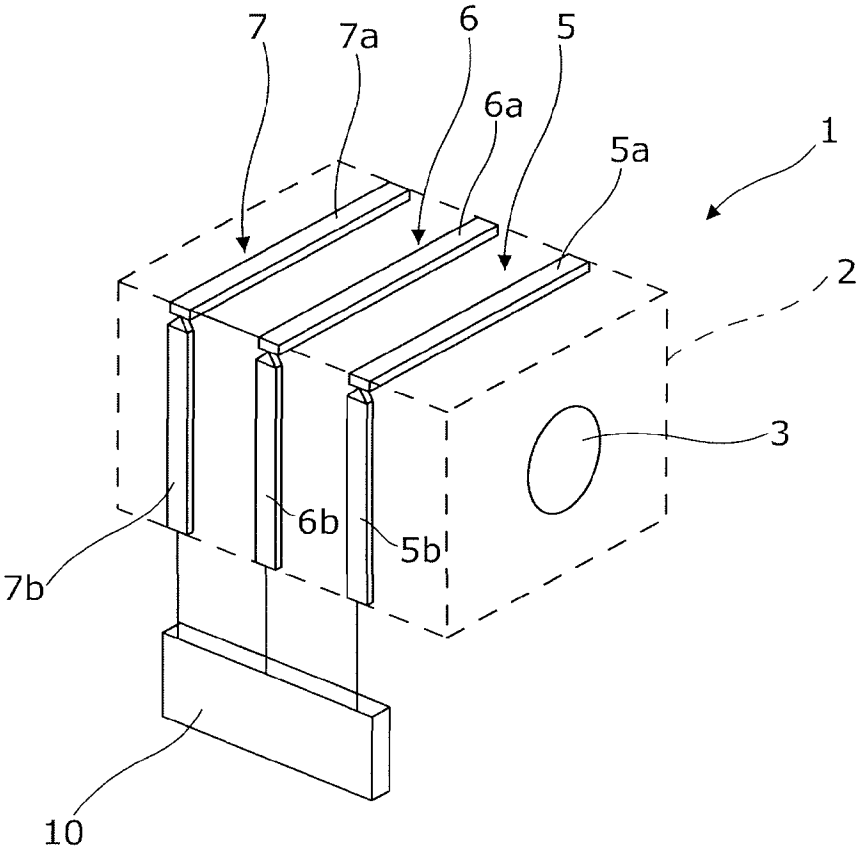
FIG. 1 is a schematic perspective view of an audio interface.

Reference is made initially to FIG. 1 which shows an audio interface 1 for use in an aircraft, which allows a passenger to connect headphones to the interface and so allow the passenger to listen to the on-board entertainment system. The interface 1 is usually provided at or adjacent to each passenger's seat. As will be described in more detail below, the interface allows crew of the aircraft to check that audio is received at the interface and so ensure correct operation of the interface.

The interface 1 comprises an opening 3, which allows a plug 30, which is connected to an audio headset or earphones by way of a cable 31, to be inserted into the socket 2 of the interface by the passenger. Within the socket, there are provided three pairs of electrical terminals 5, 6 and 7. Each terminal comprises two parts, a fixed terminal and a sprung, or resiliently deflectable, terminal. Specifically, the terminal pair 5 comprises a sprung terminal 5*a* and a fixed terminal 5*b*, the terminal pair 6 comprises a sprung terminal 6*a* and a fixed terminal 6*b*, and, the terminal pair 7 comprises a sprung terminal 7*a* and 7*a* fixed terminal 7*b*. Each of the sprung terminals is connected to the audio signal of the aircraft's inflight entertainment system by way of electrical wiring (not shown). Each of the terminals is spaced along the depth of the socket so that each terminal corresponds to the longitudinal position of a contact portion 35, 36 and 37 respectively of the pin 34 of plug 30, such that each portion contacts with a respective sprung terminal so that the audio signal is connected to the passenger's audio equipment. The terminal pair 5 is connected to a left channel audio signal, the terminal pair 6 is connected to a right audio channel and the terminal pair 7 is connected to ground.

The interface 1 further comprises a test signal circuit 10. The test signal circuit 10 comprises, for each of the left channel signal and the right channel signal, a voltage amplifier 45 and 46, a rectifier 55 and 56, logic circuitry 60, and a light-emitting diode 70.

Figure 3:
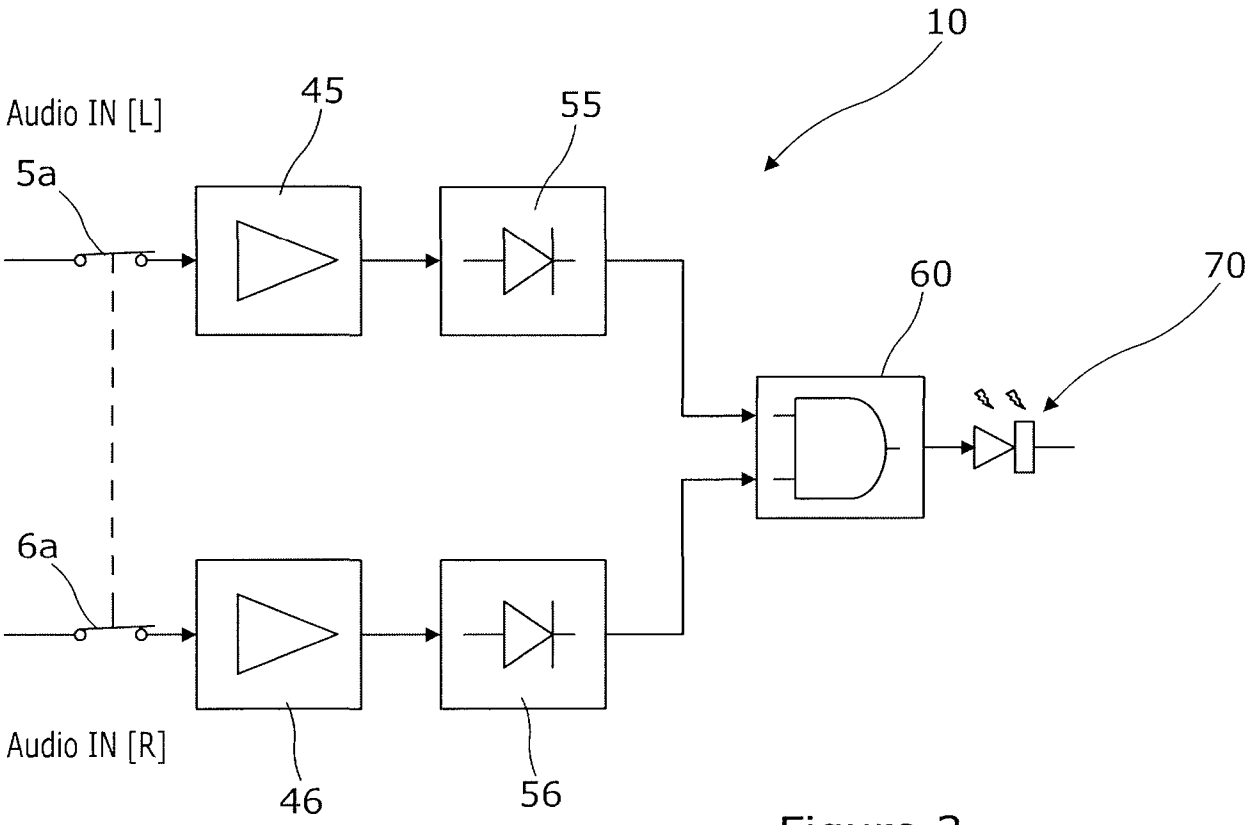
FIG. 3 is a block diagram of a test signal circuit of the audio interface of FIG. 1.
Figure 5:
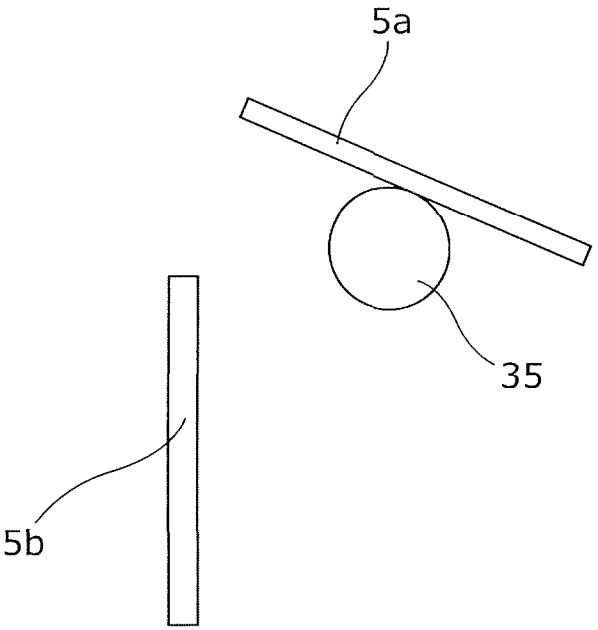
FIG. 5 is a schematic view of terminals of the interface with the plug inserted in an open condition.
Figure 4:
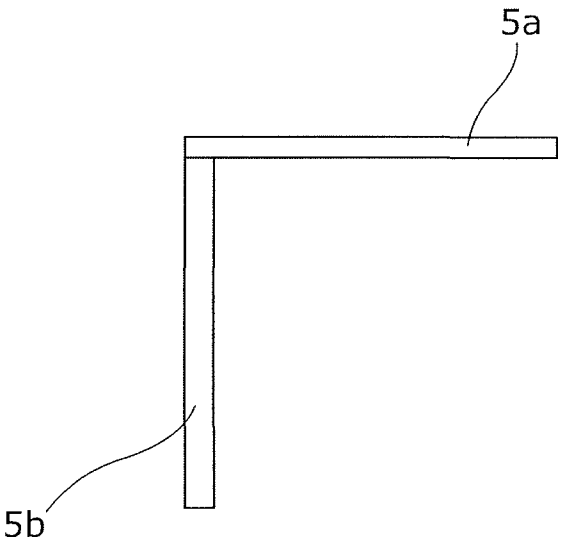
FIG. 4 is a schematic view of terminals of the interface in a closed condition.

In the condition in which the plug is not inserted into socket 2, the distal end of each of the sprung terminals electrically contacts the distal ends of the respective fixed terminals, as shown in FIG. 1. In this condition, the left, right and ground signals are connected to the test signal circuit 10, via the fixed terminals. With reference to FIG. 3 it can be seen that each of the left and right channel signals is first amplified and then rectified prior to serving as inputs for the AND gate of the logic circuitry at 60. If both left and right channels are present then the AND gate will output HIGH. This HIGH output then serves to power the LED 70. This condition, in which the LED is illuminated, is indicative of the fact that an audio signal is present at both of left and right channel terminals. Moreover, this condition is indicative of the fact that there is continuity through each of the terminals. Conveniently, the LED is arranged to radiate visible light externally of the interface so aircraft personnel can easy check whether the LED for each seat is illuminated. If it is not illuminated, then this means that one or both of the left or right audio signals is not received at the terminals of the interface, and so the fault needs to be investigated and rectified as necessary. The LED may be provided at or adjacent to the interface 1, or close to each passenger seat, so that the staff can easily identify with which seat any faulty audio interface is associated. Hitherto, this procedure of check that the audio interface of each seat was operating correctly was performed by the staff manually inserting a plug of a headset into each interface, and then manually verifying that audio could be heard. This is clearly a lengthy and laborious procedure (given that a few hundred interfaces may need to be checked as operating correctly). Such a procedure would usually be conducted in the time between when passengers have left the aircraft and prior to new passengers boarding the aircraft. During such changeover periods time is short, since other duties in making the aircraft ready for the new passengers need to performed.

It should be appreciated that when the plug 30 is inserted into the socket 2, the pin 34 engages with the sprung terminals so as to deflect them away from electrical connection with the fixed terminals and into electrical connection with the respective portions of the pin. With the plug so inserted, the audio signals are routed/diverted away from the test circuit 10 and towards the audio headset. In this condition, the LED is not powered and remains extinguished for as long as the plug is inserted. With the plug removed, the resilience of the sprung terminals returns them to being in contact with the fixed terminals.

In the above embodiment, we use the audio content generated by the entertainment system that would be heard by passengers, for the purpose of powering generation of the test signal. However, in an alternative embodiment, for the purpose of the test procedure, we substitute the audio content that would usually be directed to the interfaces for passenger entertainment, for a dedicated source test signal, used solely for the purpose of checking the operability of each of the interfaces. Such a source test signal would be transmitted to each interface in place of the usual audio content. The frequency of transmission of the source test signal may be around 15 kHz. Once the test procedure has been completed, the source test signal is discontinued and transmission of the usual audio content is then re-commenced to the interfaces.

Advantageously, in the above embodiments, no additional power supply is required, since the LED is powered from an amplified and rectified audio signal.

In an alternative embodiment, the test signal may not be displayed at or next to each seat or interface, but rather may be provided remote from the interface, for example, the output of each test circuit could be fed to a (master) monitoring station, whereby staff could immediately identify from an output given by the monitoring station any interfaces of any seats for the entire aircraft which the 'operative' test signal was not received. The combination of the monitoring station and the audio interfaces may be viewed as forming a testing system. It may be that a signal/data processor could be provided in such a system so as to determine from which interfaces an 'operative' test signal is not received, and then to display to staff at the monitoring station the identity of that/those interfaces which are determined to be faulty.

In a further alternative embodiment, instead of an audio signal being used to power a test signal, another power source may be used (ie other than the audio signal), such as for example that to a passenger equipment power supply socket. In such an embodiment, when the plug is not inserted into the socket, a switch is closed, so as to cause a test signal (powered from the power source) to be generated. However, when a plug is inserted, the switch is caused to opened, and the power source disconnected from a test signal generator.

In yet further embodiments, the test signal may be arranged to be generated even when a plug is connected to the interface.

Advantageously, the above embodiments form what may be viewed as a self-testing jack, saving considerable time and effort verifying the operability of a multitude of audio interfaces. Further advantageously, when the test signal is generated from power derived from an audio signal, (with for example, the electrical power received at the interface representative of music or audio content which is used to power the test circuit), or at least serve as a power source for generation of the test signal, this obviates the need for any additional power supply for generation of the test signal.

The invention claimed is:

1. An audio interface comprising a socket arranged to receive a plug, the socket arranged to transfer an audio signal to the plug when connected to the socket, the interface comprising a detector to determine whether an audio signal is received at the socket, the detector arranged to cause generation of as test signal to indicate that an audio signal is received at the socket, at least when the plug is not physically connected to the socket, and the socket is configured to transmit the audio signal to the plug when the plug is physically connected to the socket.

2. The audio interface as claimed in claim 1 in which the detector is arranged to cause the test signal to be generated only when the plug is not connected to the socket.

3. The audio interface as claimed in claim 2 in which the detector is arranged to deactivate a test signal generator when it is determined that the plug is connected to the socket.

4. The audio interface as claimed in claim 1 in which the detector causes discontinuation of generation of the test signal when, and during, it is determined that the plug is connected to the socket.

5. The audio interface as claimed in claim 1 in which the detector comprises a switch which controls generation of the test signal, based on whether the switch is open or closed.

6. The audio interface as claimed in claim 1 in which the socket comprises an electrical terminal and the detector is arranged to cause the test signal to be generated when it is determined that an audio signal is received at said electrical terminal of the socket.

7. The audio interface as claimed in claim 6 in which the socket comprises two or more electrical terminals and the detector is arranged to cause generation of the test signal when it is determined that an audio signal is received at both or all of the electrical terminals of the socket.

8. The audio interface as claimed in claim 1 in which the test signal generated comprises a visual indication.

9. The audio interface as claimed in claim 8 in which the audio interface comprises a light-generating component for displaying aid visual indication.

10. The audio interface as claimed in claim 1 in which the test signal is generated using power sourced from the audio signal.

11. The audio interface as claimed in claim 10 in which the detector comprises a test signal generator for generation of a test signal to indicate that an audio signal is received, at the socket, and said detector directs the audio signal towards said test signal generator when the plug is not connected to the socket.

12. The audio interface comprising:

a socket arranged to receive a plug having a pin, the socket arranged to transfer an audio signal to the plug when said plug is connected to the socket;

as detector configured to detect that said audio signal is received at the socket, the detector including a test signal generator for generation of a test signal to indicate that said audio signal is received at the socket; and a resilient element arranged to engage said pin of the plug such that on connection of the plug to the audio interface the resilient element switches said audio signal away from said test signal generator, and when the plug is not connected to the audio interface, the resilient element directs the audio signal towards said test signal generator.

13. The audio interface as claimed in claim 12 in which the resilient element is an electrical terminal arranged to carry said audio signal and preferably selectively transfer the signal to the plug or to the test signal generator.

14. The audio interface as claimed in claim 12 in which the detector serves to determine whether the plug is connected to or disconnected from the socket.

15. A test system for a plurality of audio interfaces, the system comprising a plurality of audio interfaces as claimed in claim 1 and an output device in communication with said plurality of audio interfaces to process information derived from received test signals from the audio interfaces.

* * * * *